US005167113A

United States Patent [19]

Yoshioka

[11] Patent Number: 5,167,113

[45] Date of Patent: Dec. 1, 1992

[54] FUR YARN, METHOD OF MANUFACTURING THE SAME AND FUR FABRICS WOVEN THEREOF

[76] Inventor: Yukio Yoshioka, 2723-2, Oaza Hukawa, Tone-Machi, Kitasoma-Gun Ibaraki-pref., Japan

[21] Appl. No.: 834,817

[22] Filed: Feb. 13, 1992

[51] Int. Cl.[5] ..... D02G 3/06

[52] U.S. Cl. ..... 57/236; 57/31; 57/260

[58] Field of Search ..... 57/260, 31, 32, 235, 57/259, 236

[56] References Cited

U.S. PATENT DOCUMENTS

| | | | |
|---|---|---|---|
| 1,631,086 | 5/1927 | Cunningham | 57/31 X |
| 4,606,182 | 8/1986 | Krehm et al. | 57/260 X |
| 4,637,206 | 1/1987 | Suwa | 57/260 X |
| 4,660,363 | 4/1987 | Krehm et al. | 57/260 X |

FOREIGN PATENT DOCUMENTS

| | | | |
|---|---|---|---|
| 4458 | 10/1979 | European Pat. Off. | 57/210 |

*Primary Examiner*—Joseph J. Hail, III

*Attorney, Agent, or Firm*—Fred Philpitt

[57] ABSTRACT

In a fur fabric having a fur yarn woven into a base fabric: a fur strip having a furry and a bare skin side is helically coiled around a rodlike mold form in a condition in which the furry side is disposed outside the form so as to form an assembly; the form is removed from the assembly to form a tubular roving which is further spun to form a yarn which is folded double to have its halves self-spun together under the influence of resilient shrinking effort of the halves, so as to form a completed single yarn which is woven into the base fabric in a condition in which a first one of the completed yarns is helically coiled clockwise around a first one of the warp threads, and a second yarn adjacent to the first one of the yarns is helically coiled counterclockwise around a second warp thread adjacent to the first one of the warp threads, so as to have adjacent ones of the completed yarns be opposite in coiling direction.

3 Claims, 2 Drawing Sheets

FUR YARN, METHOD OF MANUFACTURING THE SAME AND FUR FABRICS WOVEN THEREOF

BACKGROUND OF THE INVENTION

1. Field of the Invention

The present invention relates to a fur yarn, a method of manufacturing the same and fur fabrics woven of the fur yarn, the fur fabrics being formed into overcoats, stoles and like furs.

2. Description of the Prior Art

A conventional fur yarn is produced as follows: first, a starting material i.e., thin fur strip having a width of about 1 cm is twisted. Then, the thus twisted fur strip is folded double to have its halves spun together again to form a single fur yarn.

In manufacturing of the conventional fur yarn of the above type, the fur strip 1 (one side of which is a furry side 2 and the other is a bare skin side 3) is simply twisted. Consequently, as shown in FIG. 6, in the thus formed conventional fur yarn, the furry sides 2 of the yarn are spaced alternately with the bare skin sides 3 of the yarn. Hitherto, it is not possible to produce a fur yarn covered with the furry side 2 only.

As a result, in any of conventional fur fabrics woven of the above fur yarn, in order to prevent the bare skin side 3 of the yarn from being disposed in an outside of the fabric, a plenty of the fur yarn is required in weaving the fabric, which makes the fabric heavy and costly.

SUMMARY OF THE INVENTION

It is a first object of the present invention to provide a fur yarn which is made of a fur strip so as to be covered only with a furry side of the fur strip.

It is a second object of the present invention to provide a method of manufacturing the fur yarn of the present invention having the above construction.

It is a third object of the present invention to provide a fur fabric woven of a possible minimum amount of the fur yarn of the present invention having the above construction, which makes the fur fabric light in weight and cheap in manufacturing cost.

According to a first aspect of the present invention, the above objects of the present invention are accomplished by providing:

A method for manufacturing a fur yarn, characterized by the steps of:

helically coiling a thin fur strip (which is provided with a furry side and a bare skin side) around a rodlike mold form in a condition in which the furry side of the fur strip is disposed outside the rodlike mold form so as to form an assembly of the fur strip and the rodlike mold from;

removing the rodlike mold form from the assembly of the fur strip and the rodlike mold form so as to form a thin tubular fur roving;

additionally spinning the thin tubular fur moving to form an elongated fur yarn;

folding the elongated fur yarn double; and permitting the elongated fur yarn having been folded doubled to have its halves self-spun together under the influence of resilient shrinking effort of the halves, to form a completed single fur yarn.

According to a second aspect of the present invention, the above objects of the present invention are accomplished by providing:

The method for manufacturing the fur yarn, as set forth in the first aspect of the present invention, wherein:

the rodlike mold form assumes a tapered small-diameter rodlike shape.

According to a third aspect of the present invention, the above objects of the present invention are accomplished by providing:

A fur fabric constructed of a base fabric and a thin fur yarn, characterized in that:

a thin fur strip (which is provided with a furry side and a bare skin side) is helically coiled around a rodlike mold form in a condition in which the furry side of the fur strip is disposed outside the rodlike mold form so as to form an assembly of the fur strip and the rodlike mold form;

the rodlike mold form is removed from the assembly (of the fur strip and the rodlike mold form) so as to form a thin tubular fur roving;

the thin tubular fur roving is additionally spun so as to form an elongated fur yarn;

the elongated fur yarn is folded double;

the elongated fur yarn (having been folded doubled) has its halves self-spun together under the influence of resilient shrinking effort of the halves, so as to form a completed single fur yarn; and a plurality of the completed fur yarns are woven into the base fabric (which is woven with a plurality of warp threads and a plurality of cross-threads) in a condition in which a first one of the completed fur yarns is helically coiled clockwise around a first one of the warp threads, and a second fur yarn adjacent to the first one of the fur yarns is helically coiled counterclockwise around a second warp thread adjacent to the first one of the warp threads, so as to have adjacent ones of the completed fur yarns be opposite in coiling direction.

The above objects, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Hereinbelow, the present invention will be described in detail with reference to the accompanying drawings.

Figure 1:
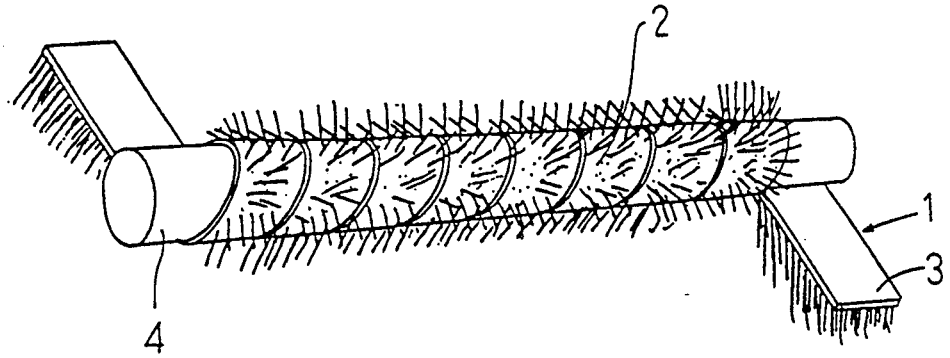
FIG. 1 is a perspective view of the fur strip wrapped around a tapered rodlike mold form.

In a method for manufacturing a fur yarn of the present invention, a first step is shown in FIG. 1 in which a fur strip 1 having a width of from approximately 5 to 8 mm is closely and helically coiled around a tapered rodlike mold form 4 so as to cover the mold form 4 with its furry side 2 only. In other words, in the first step, only a bare skin side 3 of the fur strip 1 is brought into a close contact with the tapered mold form 4 through the above helical coiling operation of the fur strip 1 around the tapered mold form 4, to form an assembly of the fur strip 1 and the mold form 4.

Figure 2:
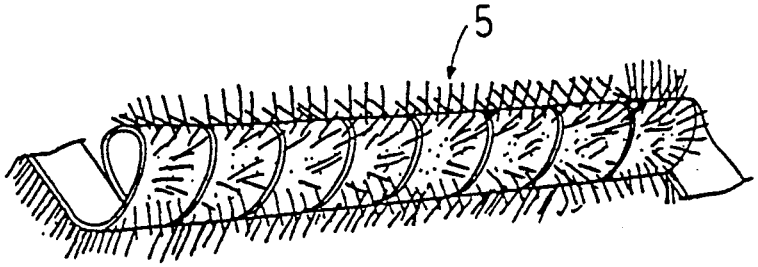
FIG. 2 is a perspective view of a tube-like compact coil constructed of the fur strip.

Then, as shown in FIG. 2, in a second step of the method for manufacturing the fur yarn of the present invention, the tapered mold form 4 is removed from the assembly of the fur strip 1 and the mold form 4, to form an intermediate product, i.e., tubular roving 5 which is entirely covered with hairs or fibers.

Figure 3:
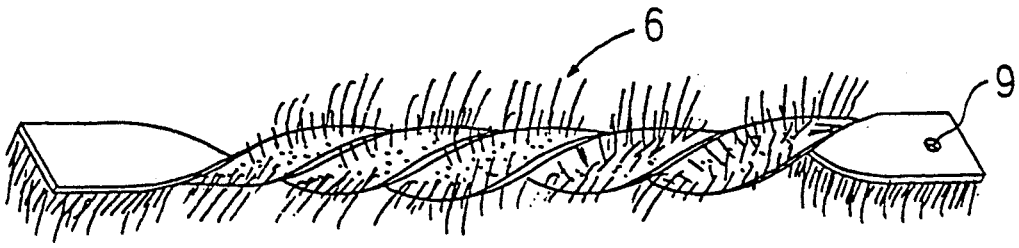
FIG. 3 is a perspective view of a fur yarn, i.e., the fur strip assuming a yarn shape covered only with the furry side of the fur strip.

The above second step is followed by a third step shown in FIG. 3 in which an end of the tubular roving 5 is fixed. On the other hand, a through-hole 9 is formed in the other end of the tubular roving 5. In spinning operation of the tubular roving 5, the through-hole 9 of the other end of the tubular roving 5 receives therein a hook portion (not shown) of a rotary shaft of a suitable rotary machine such as grinders and the like so as to be rotatably driven thereby. When the machine rotatably drives the other end of the tubular roving 5, since the one end of the tubular roving 5 is fixed, the tubular roving 5 is forcibly twisted or spun to form a fur yarn 6 entirely covered with the furry side 2 of the fur strip 1. During the above spinning operation performed in the third step, since the tubular roving 5 has been already closely helically coiled, there is no fear that the bare skin side 3 of the fur strip 1 appears in an outer peripheral surface of the fur yarn 6.

Figure 4:
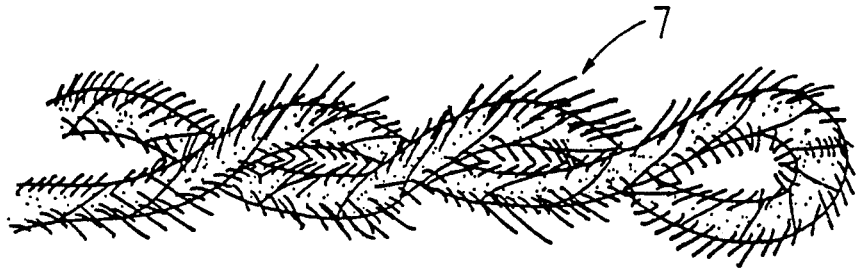
FIG. 4 is a perspective view of the fur yarn (shown in FIG. 3) having been folded double and spun.

The above third step is followed by a fourth step shown in FIG. 4 in which the fur yarn 6 thus formed in the third step is folded double so that opposite ends of the fur yarn 6 are brought into contact with each other.

Under such circumstances, the thus folded fur yarn 6 has its halves self-spun under the influence of its shrinking effort caused by the previous coiling and spinning operations applied thereto, so as to be formed into a completed single fur yarn 7.

Figure 5:
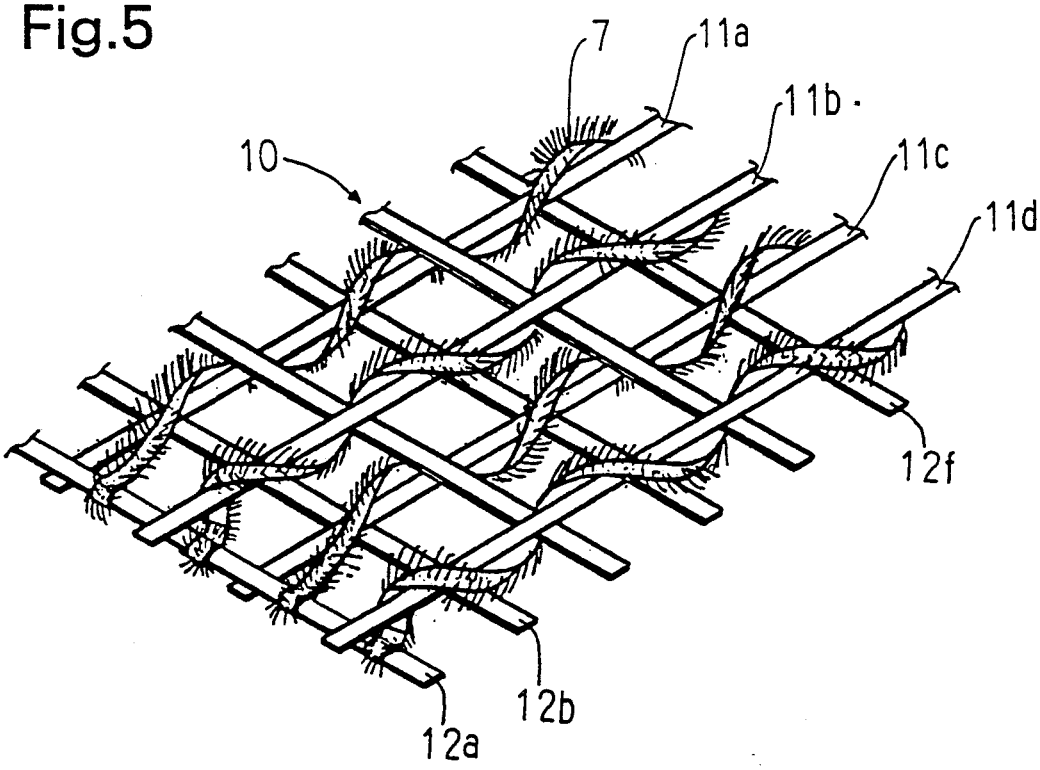
FIG. 5 is a perspective view of a base cloth into which the fur yarn is woven.
Figure 6:
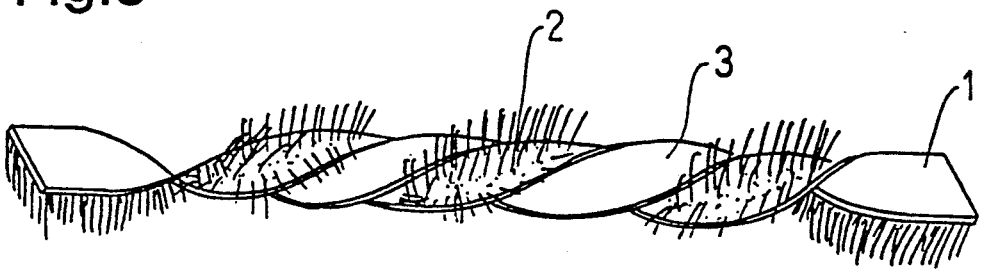
FIG. 6 is a perspective view of the conventional fur yarn in which the furry sides of the fur strip are spaced alternately with the bare skin sides of the same strip.

As shown in FIG. 5, the thus completed fur yarn 7 is woven into a base cloth (which is woven with a plurality of warp threads 11*a*, 11*b*, 11*c*, 11*d*, . . . and a plurality of cross-threads 12*a*, 12*b*, . . . 12*f*) to form a fur fabric 10.

As is clear from FIG. 5, the fur fabric 10 is constructed of: the warp threads 11*a*, 11*b*, 11*c*, 11*d*, . . . made of light-weight synthetic fibers such as polyester fibers and the like; the cross-threads 12*a*, 12*b*, . . . 12*f* made of ligh-weight synthetic fibers such as polyester fibers and the like; and a plurality of the completed fur yarns 7 each of which is helically coiled around each of the warp threads 11*a*, 11*b*, 11*c*, 11*d*,... so as to have adjacent yarns 7 be opposite in coiling direction as shown in FIG. 5.

Namely, as shown in FIG. 5, for example, in case that a first one of the fur yarns 7 is helically coiled around the first warp thread 11*a* clockwise, a second one of the fur yarns 7 is helically coiled around the second warp thread 11*b* counterclockwise, The above coiling manner of the fur yarns 7 is applied to the subsequent warp threads 11*c*, 11*d*, . . . . to form the fur fabric 10. Further, the thus formed fur fabrics 10 has each of edges thereof sewed together with an edge-cover tape (not shown) so as to be prevented from being unwoven.

In the fur fabric 10 having the above construction, since a shrinking effort of each of the fur yarns 7 woven clockwise into the fur fabric 10 is offset by that of each of the fur yarns 7 woven counterclockwise into the same fabric 10, there is no fear that the fur fabric 10 of the present invention is deformed under the influence of such shrinking effort exerted by the fur yarns 7 woven into the fabric 10.

As a result, the following effects of the present invention are clearly recognized:

(1) According to the present invention, it is possible to provide the fur yarn (which is entirely covered with the furry side of the fur strip) even when the fur strip is extremely thin in width;

(2) According to the present invention, since the fur yarn of the present invention is entirely covered with the furry side of the fur strip, it is possible to use a thin fur yarn (which has a width of, for example, up to 1 cm) in manufacturing or weaving the fur fabric 10, which makes it possible to weave the fur fabric 10 with a possible minimum amount of the fur yarn, the thus woven fur fabric 10 being light in weight and mild in texture; and (3) Further, according to the present invention, it is possible to manufacture such light-weight and mild-texture fur fabric 10 at a low cost.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed is:

1. A method for manufacturing a fur yarn, characterized by the steps of:

helically coiling a thin fur strip (which is provided with a furry side and a bare skin side) around a rodlike mold form in a condition in which said furry side of said fur strip is disposed outside said rodlike mold form so as to form an assembly of said fur strip and said rodlike mold from;

removing said rodlike mold form from said assembly of said fur strip and said rodlike mold form so as to form a thin tubular fur roving;

additionally spinning said thin tubular fur roving to form an elongated fur yarn;

folding said elongated fur yarn double; and permitting said elongated fur yarn having been folded doubled to have its halves self-spun together under the influence of resilient shrinking effort of said halves, to form a completed single fur yarn.

2. The method for manufacturing the fur yarn, as set forth in claim 1, wherein:

said rodlike mold form assumes a tapered small-diameter rodlike shape.

3. A fur yarn produced according to the method of claim 1.

* * * * *